US005653772A

United States Patent [19]

Mori et al.

[11] Patent Number: 5,653,772

[45] Date of Patent: Aug. 5, 1997

[54] METHOD OF FIXING CELLULOSE FIBERS DYED WITH A REACTIVE DYE

[75] Inventors: Yasuharu Mori, Tokyo; Nobuhiko Ueno, Yokohama; Kouji Midori, Fukui; Juji Uchida, Sabae; Masayuki Maeno, Fukui, all of Japan

[73] Assignee: Nicca Chemical Co., Ltd., Fukui, Japan

[21] Appl. No.: 682,391

[22] Filed: Jul. 17, 1996

Related U.S. Application Data

[63] Continuation of Ser. No. 256,216, filed as PCT/JP93/01829, Dec. 16, 1993, abandoned.

[51] Int. Cl.[6] ..... D06P 5/08; D06P 5/06

[52] U.S. Cl. ..... 8/495; 8/552; 8/554; 8/558; 8/543

[58] Field of Search ..... 8/490, 495, 554, 8/543–549, 558, 552

[56] References Cited

U.S. PATENT DOCUMENTS

| | | | |
|---|---|---|---|
| 4,403,072 | 9/1983 | Bunes | 525/353 |
| 4,489,197 | 12/1984 | Wang et al. | 525/328.2 |
| 4,526,933 | 7/1985 | Wang et al. | 525/326.8 |
| 4,818,341 | 4/1989 | Degen et al. | 162/168.2 |
| 5,324,787 | 6/1994 | Pinschmidt, Jr. et al. | 515/328.2 |

FOREIGN PATENT DOCUMENTS

| | | |
|---|---|---|
| 0196587 | 10/1986 | European Pat. Off. . |
| 0232519 | 8/1987 | European Pat. Off. . |
| 0142337 | 5/1995 | European Pat. Off. . |
| 3720508 | 1/1988 | Germany . |
| 6-2288 | 1/1994 | Japan . |

OTHER PUBLICATIONS

Database WPI Section CH, Week 8836 Derwent Publication Ltd., London GB; Class A87, AN 88–252937 XP002013713 & JP–A–63 182 485 (Nippon Senka KK), 27 Jul. 1988 —Abstract.

Patent Abstracts of Japan, vol. 010, No. 318 (C–381), Oct. 29, 1986 & JP–A–61 130318 (Sumitomo Chem. Co., Ltd.), Jun. 18, 1986 —Abstract.

*Primary Examiner*—Margaret Einsmann
*Attorney, Agent, or Firm*—McAulay Fisher Nissen Goldberg & Kiel, LLP

[57] ABSTRACT

A method of fixing cellulose fibers dyed with a reactive dye, which comprises a homopolymer containing a vinylamine structural unit, a copolymer containing from 5 to 90% by weight of a vinylamine structural unit and from 5 to 90% by weight of a diallylamine structural unit, a copolymer containing from 5 to 90% by weight of a vinylamine structural unit, from 5 to 90% by weight of structural unit of a vinyl compound copolymerizable with the vinylamine, or copolymer containing from 5 to 90% by weight of a vinylamine structural unit, from 5 to 90% weight of a diallylamine structural unit and from 5 to 90% by weight of a structural unit of a vinyl compound copolymerizable with vinylamine and diallylamine, and/or a salt of the homopolymer or copolymers.

20 Claims, No Drawings

METHOD OF FIXING CELLULOSE FIBERS DYED WITH A REACTIVE DYE

This is a continuation of application Ser. No. 08/256,216 filed Jul. 5, 1994 now abandoned, which is the national phase application of PCT/JP93/01829 filed Dec. 16, 1993.

TECHNICAL FIELD

The present invention relates to a dye fixing agent for reactive dyes. The present invention particularly relates to a dye fixing agent which improves the chlorine fastness and the wet fastness of dyed materials dyed with a reactive dye.

BACKGROUND ART

Since reactive dyes have bright color shade and good wet fastness, they are often used as dyes for cellulose fibers. Moreover, various dye fixing agents for reactive dyes have been developed to improve their wet fastness. On the other hand, a great disadvantage of reactive dyes is that the dyes are changed in color due to oxidation of the dyes with chlorine contained in tap water or in a bleaching agent. Dye fixing agents, etc., having properties for improving chlorine fastness have been developed in response to this problem.

Examples of the dye fixing agents are a homopolymer of a monoallylamine derivative (Japanese Unexamined Patent Publication Kokai No. 58-31185), a copolymer of a monoallylamine derivative and a diallylamine derivative (Japanese Unexamined Patent Publication Kokai No. 60-110987) and a copolymer of a tertiary amino group-containing acrylamide derivative and a diallylamine derivative (Japanese Unexamined Patent Publication Kokai No. 1-272887, and the like.

However, though the dye fixing agents of allylamine type mentioned above exhibit appreciable effects, satisfactory effects still cannot be obtained from the standpoint of practical use of cellulose fibers in the current market situation, where a higher degree of improvement in chlorine fastness is required. Moreover, in heat treating a printed fabric at the time of applying these dye fixing agents of allylamine type, yellowing of undyed portions caused by the dye fixing agents is sometimes observed, and becomes a problem. Furthermore, the dye fixing agents of allylamine type do not improve the dye fastness of turquoise blue dyes which are frequently used as a bright color, and, therefore, an improvement of the fixing agents is desired.

DISCLOSURE OF INVENTION

Accordingly, the present invention is intended to provide a dye fixing agent which can overcome the problems as described above and improve the chlorine fastness and wet fastness of dyed materials dyed with a reactive dye.

As a result of intensive research to solve the problems mentioned above, the present inventors have discovered that posttreatment of cellulose fibers, dyed with a reactive dye, with a homopolymer or copolymer containing a vinylamine structural unit and/or the salt of the homopolymer or copolymer, which have never been used as a dye fixing agent, significantly improves the chlorine fastness and wet fastness of the dyed materials, and the present invention has thus been achieved.

The present invention, therefore, provides a dye fixing agent used for cellulose fibers dyed with a reactive dye, which comprises a homopolymer containing a vinylamine structural unit of the general formula (I) mentioned below and/or a salt of the homopolymer, or a copolymer containing from 5 to 90% by weight of a vinylamine structural unit of the general formula (I) mentioned below and from 5 to 90% by weight of a diallylamine structural unit of the general formula (II) mentioned below and/or a salt of the copolymer, or a copolymer containing from 5 to 90% by weight of a vinylamine structural unit of the general formula (I) mentioned below and from 5 to 90% by weight of a structural unit of a vinyl compound copolymerizable with the vinylamine, and/or a salt of the copolymer, or a copolymer containing from 5 to 90% by weight of a vinylamine structural unit of the general formula (I) mentioned below, from 5 to 90% by weight of a diallylamine structural unit of the general formula (II) mentioned below and from 5 to 90% by weight of a structural unit of a vinyl compound copolymerizable with the vinylamine and the diallylamine and/or a salt of the copolymer:

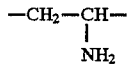

(I)

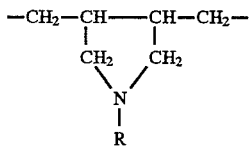

(II)

wherein R is a hydrogen atom or alkyl group of 1 to 4 carbon atoms.

BEST MODE FOR CARRYING OUT THE INVENTION

When the structural unit of the general formula (I) is in a salt form, the salt may be in an amine salt form with an acid such as hydrochloric acid, nitric acid, sulfuric acid, phosphoric acid, formic acid, acetic acid, propionic acid, sulfamic acid and methanesulfonic acid.

Concrete examples of the diallylamine forming the structural unit of the general formula (II) are diallylamine which is a secondary amine, methyldiallylamine and ethyldiallylamine which are tertiary amines, and the like. Moreover, when the structural unit of the general formula (II) is in a salt form, the salt my be in an amine salt form with an acid such as hydrochloric acid, nitric acid, sulfuric acid, phosphoric acid, formic acid, acetic acid, propionic acid, sulfamic acid and methanesulfonic acid. Furthermore, when R is an alkyl group, the structural unit may form a quaternary ammonium with such an agent for forming a quaternary ammonium salt as an alkyl halide (alkyl group of 1 to 4 carbon atoms), a benzyl halide or dialkyl (alkyl group of 1 to 2 carbon atoms) sulfate.

Examples of the vinyl compound copolymerizable with vinylamine and diallylamine are N-vinylamides such as N-vinylformamide, N-vinylacetamide and N-vinylpropionamide, nonionic monomers such as styrene, N-methylolacrylamide, N-methylallylamine, N-ethylallylamine, N-propylallylamine, N,N-dimethylallylamine, N,N-diethylallylamine, (meth) acrylonitrile, (meth)acrylamide, N-substitued (meth) acrylamide, (meth)acrylic esters, vinyl esters, vinyl ethers, vinyl alcohol and allyl ethers, anionic monomers such as (meth)acrylic acid, α,β-unsaturated dicarboxylic acids, N-sulfoalkyl(meth)acrylamides, sulfoalkyl (meth)acrylates and (meth)allylsulfonic acid, dialkylaminoalkyl (meth) acrylates, N-(dialkylaminoalkyl) (meth)acrylamides and allylamine.

The polymers as mentioned above which form the dye fixing agents of the present invention may be obtained, for example, by (co)polymerizing an N-vinylamide represented by the general formula (III)

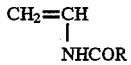

(III)

wherein R is a hydrogen atom or alkyl group of 1 to 4 carbon atoms, or its derivative and partially hydrolyzing the polymer thus obtained.

Though polymerization may be carried out either by radical polymerization or ion polymerization, radical polymerization is preferred from the standpoint of easily controlling the molecular weight of the polymer. Though any of the conventional polymerization initiators may be used as the polymerization initiator for radical polymerization, azo compounds are preferred to obtain the polymer in a good yield. Examples of the particularly preferable initiators are hydrochloric acid salt or acetic acid salt of 2,2'-azobis-4-amidinopropane, sodium 4,4'-azobis-4-cyanovalerate and hydrochloric acid salt or sulfuric acid salt of azobis N,N'-dimethyleneisobutylamidine. These polymerization initiators are usually used in an amount of 0.01 to 1% by weight based on the monomer.

The monomer may be polymerized by any of the conventional methods such as bulk polymerization, solution polymerization, suspension polymerization and emulsion polymerization. Polymerization reaction is generally conducted at a temperature of 30° to 100° C. under an inert gas flow. Solution polymerization is exemplified by polymerization in an aqueous solution containing from 5 to 60% by weight of monomers. Suspension polymerization is exemplified by a method comprising conducting polymerization in a water-in-oil type dispersion state of an aqueous solution containing from 20 to 80% by weight of monomers using a hydrophobic solvent and a dispersion stabilizer. Emulsion polymerization is exemplified by a method comprising conducting polymerization in an oil-in-water type or water-in-oil type emulsion state of an aqueous solution containing from 20 to 60% by weight of monomers using a hydrophobic solvent and an emulsifier.

The (co)polymer obtained as described above is subsequently hydrolyzed to obtain the desired polymer. Hydrolysis may be carried out either under acidic conditions or basic conditions. However, in view of the possibility of corrosion of the reaction system, hydrolysis is preferably carried out under basic conditions. In addition, in the case of acidic hydrolysis, the amino group of the vinylamine structural unit formed by hydrolysis is in the form of a salt, while in the case of basic hydrolysis, the amino group is in a free form. However, acid may be added in the latter case after hydrolysis to convert part or all of the free amine into the form of a salt.

Acid compounds used in the acidic hydrolysis are preferably strongly acidic, and examples thereof are hydrochloric acid, hydrobromic acid, hyfrofluoric acid, sulfuric acid, nitric acid, phosphoric acid, sulfamic acid, methanesulfonic acid, and the like. In view of the solubility of the hydrolyzed products, monobasic acids are preferred. The basic compounds used in the basic hydrolysis are exemplified by sodium hydroxide, potassium hydroxide, lithium hydroxide, quaternary ammonium hydroxide, ammonia, low molecular weight primary amines, secondary amines, and the like.

The acid or base is suitably used in an amount from 0.1 to 5 times as much as the amide group in the (co)polymer in terms of moles in accordance with the desired modification ratio. The reaction temperature and the reaction time are preferably in the ranges from 50° to 110° C., and from 1 to 8 hours, respectively. Moreover, hydrolysis may be carried out not only in an aqueous solution but also in any of various states such as in a solvent mixture system (e.g., water-alcohol) and in an inhomogeneous solvent system (e.g., water-hexane, water-toluene). Furthermore, hydrolysis may also be carried out by contacting a water-containing solid polymer with a gaseous acid.

In addition, hydrolysis may also be carried out while an anti-gelling agent such as hydroxylamine hydrochloride or hydroxylammine sulfate is arbitrarily added to prevent gellation caused by impurities during hydrolysis. Moreover, in general, it is particularly preferable to carry out hydrolysis after treating the reaction mixture with the anti-gelling agent.

There is no specific limitation on the method for treating dyed materials with the dye fixing agent of the present invention, and any of the conventional methods can be suitably used.

Examples of the cellulose fibers to which the dye fixing agent of the present invention can be applied are cotton, rayon, and the like, and the fixing agent can further be applied to composite fibers of cellulose fibers and polyester, cellulose fibers and silk, and the like. There is no specific limitation on the reactive dye which dyes cellulose fibers so long as it is a general one. The reactive dye includes an organic dye which is a water-soluble anionic dye having a reactive group such as a vinylsulfone group, a dichlorotriazine group, a monochlorotriazine group or dichloroquinoxaline group. The dyeing method is exemplified by conventional immersion dyeing, continuous dyeing, print dyeing, and the like.

Examples of the method for treating a dyed material with the dye fixing agent of the present invention include a method wherein a dyed material to be treated is immersed in an aqueous solution containing from 1 to 5 g/l of the polymer as mentioned above, squeezed with a mangle, etc., and hot dried, and a method wherein a dyed material to be treated is immersed in an aqueous solution containing from 0.1 to 5 g/l of the polymer as mentioned above at a temperature from room temperature to 80° C. for about 5 to 30 minutes, washed with water, and dried.

The present invention will be further explained by making reference to examples, but it should be construed that the present invention is in no way limited thereto.

EXAMPLE 1

To 20 g of N-vinylformamide was added 62 g of water, and the resultant aqueous monomer solution was heated to 60° C. Azobis(2-amidinopropane) hydrochloride was added thereto in an amount of 0.5% by weight based on the monomer, and polymerization was carried out for 8 hours. To the reaction mixture was added 29.4 g of 35% hydrochloric acid (amount equivalent to N-vinylformamide) after the completion of polymerization, and the product was hydrolyzed at 80° C. for 5 hours. Methanol was added to the polymerization solution to form precipitates. The resultant mixture was filtered, and the residue was dried under reduced pressure to obtain a white polyvinylamine hydrochloride in a conversion of 98%.

EXAMPLE 2

To a mixture of 10 g of N-vinylformamide and 10 g of dimethyldiallylammonium chloride was added 71 g of water, and the resultant aqueous monomer solution was heated to 60° C. Azobis(2-amidinopropane) hydrochloride was added thereto in an amount of 0.5% by weight based on the monomer, and polymerization was carried out for 8 hours. To the reaction mixture was added 14.7 g of 35% hydrochloric acid (amount equivalent to N-vinylformamide) after the completion of polymerization. The product was hydrolyzed at 80° C. for 5 hours. Methanol was added to the polymerization solution to form precipitates. The resultant mixture was filtered, and the residue was dried under reduced pressure to obtain a white copolymer of polyvinylamine hydrochloride and dimethyldiallylammonium chloride in a conversion of 95%.

EXAMPLE 3

To a mixture of 10 g of N-vinylformamide and 10 g of acrylonitrile was added 71 g of water, and the resultant aqueous monomer solution was heated to 60° C. Azobis(2-amidinopropane) hydrochloride was added thereto in an amount of 0.5% by weight based on the monomer, and polymerization was carried out for 8 hours. To the reaction mixture was added 14.7 g of 35% hydrochloric acid (amount equivalent to N-vinylformamide) after the completion of polymerization, and the product was hydrolyzed at 80° C. for 5 hours. Methanol was added to the polymerization solution to form precipitates, and the resultant mixture was filtered, and dried under reduced pressure to obtain a white copolymer of polyvinylamine hydrochloride and acrylonitrile in a conversion of 96%.

EXAMPLE 4

To a mixture of 10 g of N-vinylformamide, 5 g of dimethyldiallylammonium chloride and 5 g of acrylonitrile was added 71 g of water, and the resultant aqueous monomer solution was heated to 60° C. Azobis(2-amidinopropane) hydrochloride was added thereto in an amount of 0.5% by weight based on the monomers, and polymerization was carried out for 8 hours. To the reaction mixture was added 14.7 g of 35% hydrochloric acid (amount equivalent to N-vinylformamide) after the completion of polymerization, and the product was hydrolyzed at 80° C. for 5 hours. Methanol was added to the polymerization solution to form precipitates, and the resultant mixture was filtered, and dried under reduced pressure to obtain a white copolymer of polyvinylamine hydrochloride, dimethyldiallylammonium chloride and acrylonitrile in a conversion of 95%.

EXAMPLE 5

In a 1-liter reaction vessel equipped with a stirrer, a nitrogen inlet tube and a condenser was placed 191 g of deionized water, and the system was deaerated at room temperature by introducing nitrogen thereinto. The mixture was heated to 70° C., and 6 g of an aqueous solution containing 10% of 2,2'-azobis-2-amidinopropane dihydrochloride was added. A monomer solution prepared by adding 30.1 g of deionized water to 69.9 g of N-vinylformamide (purity: 85.7%) and adjusting the pH to 6.5 with 1 N aqueous sodium hydroxide was added to the mixture in the reaction vessel over a period of 2 hours. One hour after starting to add the monomer solution, 3 g of an aqueous solution containing 10% of 2,2'-azobis-2-amidinopropane dihydrochloride was further added, and the reaction was further carried out for 3 hours to obtain a solution containing 20% by weight of an N-vinylformamide polymer.

In a reaction vessel equipped with a stirrer and a thermostat was placed 200 g of the aqueous solution containing the N-vinylformamide polymer thus obtained, and 0.52 g of hydroxylammonium sulfate was added thereto, followed by stirring at 50° C. for 1 hour. To the mixture was added 53.8 g of an aqueous solution containing 35% by weight of sodium hydroxide, and the contents were heated, followed by basic hydrolysis at 80° C. for 5 hours. The mixture was then cooled to room temperature, and the pH was adjusted to 7.5 by adding 24.5 g of an aqueous solution containing 25% of hydrochloric acid.

The analysis of the polymer thus obtained confirmed that the polymer contained 35% by mole of a N-vinylformamide structural unit and 65% by mole of a vinylamine structural unit.

Evaluation of perspiration fastness

Aqueous solutions containing 4 g/l of each of the polymers obtained in Examples 1 to 5 was prepared. A cotton fabric continuously dyed with a reactive dye as described below at a concentration of 5% (based on the weight of fibers) was then immersed in the solution obtained above, squeezed with a mangle, and heat treated at 150° C. for 90 sec. The pickup was 70%. Dyes used herein were Kayacion Red P-4BN and Kayacion Blue P-5R (trade name, manufactured by Nippon Kayaku Co., Ltd.).

An aqueous solution containing 4 g/l of a polymer of monoallylamine hydrochloride was similarly prepared, and a cotton fabric was similarly treated as a Comparative Example.

In addition, the continuously dyed cotton fabrics used in the test were dyed under the conditions as described below.

| Formulation of dye bath (g/l) | |
|---|---|
| Dye | X |
| Sodium arginate | 0.5 |
| Urea | 100 |
| Soda ash | 15 |
| Sodium m-nitrobenzenesulfonate | 5 |

A cotton fabric was treated by the following procedures (1) to (4).

(1) Padding (2) Drying (at 1050° C. for 3 minutes)

(3) Baking (at 160° C. for 2 minutes)

(4) Soaping (at 90° C. for 5 minutes)

The perspiration fastness of the dyed cotton fabric thus treated was evaluated in accordance with JIS L 0848 (alkaline perspiration method). The results are summarized in Table 1.

TABLE 1

| Persipiration Fastness | | | | |
|---|---|---|---|---|
| Dye fixing | Kayacion Red P-4BN | | Kayacion Blue P-5R | |
| Agent | A | B | A | B |
| — | 1–2 | 1–2 | 2 | 2 |
| Example 1 | 4 | 4–5 | 4–5 | 4–5 |
| Example 2 | 5 | 5 | 5 | 5 |
| Example 3 | 5 | 5 | 5 | 5 |
| Example 4 | 5 | 5 | 5 | 5 |
| Example 5 | 5 | 5 | 5 | 5 |
| Comp. Ex. | 3–4 | 4 | 3–4 | 4 |

Note:
A: a stained cotton fabric
B: a stained silk fabric

The evaluated values in Table 1 were obtained by evaluating the stain of an undyed fabric (cotton, silk) prior to and subsequent to the test on the basis of the gray scale for staining. The evaluated values are classified into 5,4-5, 4, 3-4, 3, 2-3, 2, 1-2 or 1. A larger evaluated value signifies that the degree of staining is less and the fastness is better.

Evaluation of chlorine fastness

Aqueous solutions containing 4 g/l of each of the polymers obtained in Examples 1 to 5 was prepared. A cotton fabric continuously dyed with a reactive dye as described below at a concentration of 0.5% (based on the weight of fibers) was then immersed in the solution obtained above, squeezed with a mangle, and heat treated at 150° C. for 90 sec. The pickup was 70%. Dyes used herein were Cibacron Blue 3R (trade name, manufactured by Ciba Geigy) and Kayacion Gray P-NR (trade name, manufactured by Nippon Kayaku Co., Ltd.).

An aqueous solution containing 4 g/l of a polymer of monoallylamine hydrochloride was similarly prepared, and a cotton fabric was similarly treated as a Comparative Example. In addition, the continuously dyed cotton fabrics used in the test were dyed in the same manner as in the case of the dyed cotton fabrics used in the evaluation of perspiration fastness.

The chlorine fastness of the dyed cotton fabric thus treated was evaluated in accordance with JIS L 0884 (weak test and strong test). The results are summarized in Table 2.

TABLE 2

| Dye fixing agent | Chlorine Fastness: Cibacron Blue 3R A | Cibacron Blue 3R B | Kayacion Gray P-NR A | Kayacion Gray P-NR B |
|---|---|---|---|---|
| — | 2 | 1–2 | 2 | 1 |
| Example 1 | 4 | 3–4 | 4 | 3–4 |
| Example 2 | 4 | 3–4 | 4 | 3–4 |
| Example 3 | 4–5 | 4 | 4–5 | 3–4 |
| Example 4 | 4–5 | 4 | 4–5 | 3–4 |
| Example 5 | 4 | 3–4 | 4 | 3–4 |
| Comp. Ex. | 3–4 | 3 | 3–4 | 3 |

Note:
A: weak test
B: strong test

The evaluated values in Table 2 were obtained by evaluating the decoloration of a dyed and treated fabric prior to and subsequent to the test on the basis of the gray scale for change in color. The evaluated values are classified into 5, 4-5, 4, 3-4, 3, 2-3, 2, 1-2 or 1. A larger evaluated value signifies that the degree of change in color is less and the fastness is better.

Evaluation of yellowing caused by heat treatment

An aqueous solution mixture containing 4 g/l of any of the polymers obtained in Examples 1 to 5 and 3 g/l of Hakkol BRK (trade name of an optical brighter manufactured by Showa Kagaku Kogyo K.K.) was prepared. A cotton broad cloth was then immersed in the solution, squeezed with a mangle, and heat treated at 150° C. for 90 sec. The pickup was then 70%.

The whiteness of the treated fabric was then measured using a Macbeth Color Eye MS-2020 (trade name of a colorimeter manufactured by Macbeth Co., Ltd.), and obtained as a Hunter White Index (WI value). A larger value of the WI value signifies that the fabric is whiter. The results thus obtained are summarized in Table 3.

TABLE 3

| Dye fixing agent | Yellowing Caused by Heat Treatment: WI value |
|---|---|
| — | 112 |
| Example 1 | 107 |
| Example 2 | 109 |
| Example 3 | 108 |
| Example 4 | 109 |
| Example 5 | 109 |
| Comp. Ex. | 101 |

Note: WI value of the initial cotton fabric: 88

INDUSTRIAL APPLICABILITY

The present invention provides a dye fixing agent which improves the chlorine fastness of dyed materials having been prepared by dying with a reactive dye, decreases the yellowing of the fibers caused by heat treatment, and improves the wet fastness thereof.

We claim:

1. A method of fixing cellulose fibers dyed with a reactive dye, which comprises applying to the dyed cellulose fibers at least one member selected from the group consisting of a homopolymer containing a vinylamine structural unit of the general formula (I)

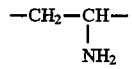

(1)

or a salt of the homopolymer or both.

2. The method according to claim 1, wherein said vinylamine structural unit forms a salt with hydrochloric acid, nitric acid, sulfuric acid, phosphoric acid, formic acid, acetic acid, propionic acid, sulfamic acid or methanesulfonic acid.

3. A method of fixing cellulose fibers dyed with a reactive dye, which comprises applying to the dyed cellulose fibers at least one member selected from the group consisting of a copolymer containing from 5 to 90% by weight of a vinylamine structural unit of the general formula (I) and from 5 to 90% by weight of a diallylamine structural unit of the general formula (II)

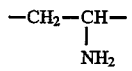

(I)

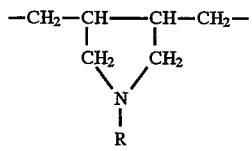

(II)

wherein R is a hydrogen atom or alkyl group of 1 to 4 carbon atoms, or a salt of the copolymer or both.

4. The method according to claim 3, wherein said vinylamine structural unit forms a salt with hydrochloric acid, nitric acid, sulfuric acid, phosphoric acid, formic acid, acetic acid, propionic acid, sulfamic acid or methanesulfonic acid.

5. The method according to claim 3, wherein said diallylamine structural unit forms a salt with hydrochloric acid, nitric acid, sulfuric acid, phosphoric acid, formic acid, acetic acid, propionic acid, sulfamic acid or methanesulfonic acid, or said diallylamine structural unit forms a quaternary ammonium salt with an alkyl halide, a benzyl halide or dialkyl sulfate.

6. A method of fixing cellulose fibers dyed with a reactive dye, which comprises applying to the dyed cellulose fibers at least one member selected from the group consisting of a copolymer containing from 5 to 90% by weight of a vinylamine structural unit of the general formula (I)

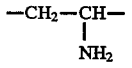

(I)

and from 5 to 90% by weight of a structural unit of a vinyl compound copolymerizable with the vinylamine or a salt of the copolymer or both, or a copolymer containing from from 5 to 90% by weight of the vinylamine structural unit of the general formula (I), from 5 to 90% by weight of a diallylamine structural unit of the general formula (II)

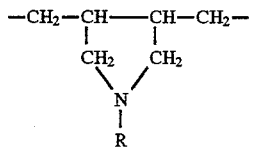

(II)

wherein R is a hydrogen atom or alkyl group of 1 to 4 carbon atoms, and from 5 to 90% by weight of a structural unit of a vinyl compound copolymerizable with the vinylamine and the diallylamine or a salt of the copolymer or both.

7. The method according to claim 6, wherein said vinylamine structural unit forms a salt with hydrochloric acid, nitric acid, sulfuric acid, phosphoric acid, formic acid, acetic acid, propionic acid, sulfamic acid or methanesulfonic acid.

8. The method according to claim 6, wherein said diallylamine structural unit forms a salt with hydrochloric acid, nitric acid, sulfuric acid, phosphoric acid, formic acid, acetic acid, propionic acid, sulfamic acid or methanesulfonic acid, or said diallylamine structural unit forms a quaternary ammonium salt with an alkyl halide, a benzyl halide or dialkyl sulfate.

9. The method according to claim 6, wherein said vinyl compound is selected from the group consisting of N-vinylamides such as N-vinylformamide, N-vinylacetamide and N-vinylpropionamide, nonionic monomers styrene, N-methylolacrylamide, N-methylallylamine, N-ethylallylamine, N-propylallylamine, N,N-dimethylallylamine, N,N-diethylallylamine, (meth)acrylonitrile, (meth)acrylamide, N-substituted (meth)acrylamide, (meth)acrylic esters, vinyl esters, vinyl ethers, vinyl alcohol and allyl ethers, anionic monomers (meth)acrylic acid, α,β-unsaturated dicarboxylic acids, N-sulfoalkyl(meth)acrylamides, sulfoalkyl(meth) acrylates and (meth)allylsulfonic acid, dialkylaminoalkyl (meth)acrylates, N-(dialkylaminoalkyl)(meth)acrylamides and allylamine.

10. The method according to claim 4, wherein said diallylamine structural unit forms a salt with hydrochloric acid, nitric acid, sulfuric acid, phosphoric acid, formic acid, acetic acid, propionic acid, sulfamic acid or methanesulfonic acid, or said diallylamine structural unit forms a quaternary ammonium salt with an alkyl halide, a benzyl halide or dialkyl sulfate.

11. The method according to claim 7, wherein said diallylamine structural unit forms a salt with hydrochloric acid, nitric acid, sulfuric acid, phosphoric acid, formic acid, acetic acid, propionic acid sulfamic acid or methanesulfonic acid, or said diallylamine structural unit forms a quaternary ammonium salt with an alkyl halide, a benzyl halide or dialkyl sulfate.

12. The method according to claim 7, wherein said vinyl compound is selected from the group consisting of N-vinylamides such as N-vinylformamide, N-vinylacetamide and N-vinylpropionamide, nonionic monomers styrene, N-methylolacrylamide, N-methylallylamine, N-ethylallylamine, N-propylallylamine, N,N-dimethylallylamine, N,N-diethylallylamine, (meth)acrylonitrile, (meth)acrylamide, N-substituted (meth)acrylamide, (meth)acrylic esters, vinyl esters, vinyl ethers, vinyl alcohol and allyl ethers anionic monomers (meth)acrylic acid α,β-unsaturated dicarboxylic acids, N-sulfoalkyl(meth)acrylamides, sulfoalkyl(meth) acrylates, and (meth)allylsulfonic acid, dialkylaminoalkyl (meth)acrylates, N-(dialkylaminoalkyl) (meth)acrylamides and allylamine.

13. The method according to claim 8, wherein said vinyl compound is selected from the group consisting of N-vinylamides such as N-vinylformamide, N-vinylacetamide and N-vinylpropionamide, nonionic monomers styrene, N-methylolacrylamide, N-methylallylamine, N-ethylallylamine, N-propylallylamine, N,N-dimethylallylamine, N,N-diethylallylamine, (meth)acrylonitrile, (meth)acrylamide, N-substituted (meth)acrylamide, (meth)acrylic esters, vinyl esters, vinyl ethers, vinyl alcohol and allyl ethers, anionic monomers (meth)acrylic acid α,β-unsaturated dicarboxylic acids, N-sulfoalkyl(meth)acrylamides, sulfoalkyl(meth) acrylates, and (meth)allylsulfonic acid, dialkylaminoalkyl (meth)acrylates, N-(dialkylaminoalkyl) (meth)acrylamides and allylamine.

14. The method according to claim 5, wherein said alkyl halide comprises an alkyl group having 1 to 4 carbon atoms.

15. The method according to claim 5, wherein said dialkyl sulfate comprises an alkyl group having from 1 to 2 carbon atoms.

16. The method according to claim 8, wherein said alkyl halide comprises an alkyl group having 1 to 4 carbon atoms.

17. The method according to claim 8, wherein said dialkyl sulfate comprises an alkyl group having from 1 to 2 carbon atoms.

18. The method according to claim 10, wherein said alkyl halide comprises an alkyl group having 1 to 4 carbon atom.

19. The method according to claim 10, wherein said dialkyl sulfate comprises an alkyl group having from 1 to 2 carbon atoms.

20. The method according to claim 11, wherein said alkyl halide comprises an alkyl group having from 1 to 4 carbon atoms, and said dialkyl sulfate comprise an alkyl group having from 1 to 2 carbon atoms.

* * * * *